US006490231B1

(12) United States Patent
Takahashi et al.

(10) Patent No.: US 6,490,231 B1
(45) Date of Patent: Dec. 3, 2002

(54) INTERMITTENT FEEDING MECHANISM

(75) Inventors: Takashi Takahashi, Chiba (JP); Tsuyoshi Tanaka, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/582,022

(22) PCT Filed: Dec. 24, 1998

(86) PCT No.: PCT/JP98/05938

§ 371 (c)(1),
(2), (4) Date: Aug. 29, 2000

(87) PCT Pub. No.: WO99/34267

PCT Pub. Date: Jul. 8, 1999

(30) Foreign Application Priority Data

Dec. 25, 1997 (JP) ..... 9-358075

(51) Int. Cl.[7] ..... G04B 19/24; G04B 15/00

(52) U.S. Cl. ..... 368/38; 368/37; 368/124; 368/220

(58) Field of Search ..... 368/37, 38, 76, 368/185, 187, 192, 220, 124

(56) References Cited

U.S. PATENT DOCUMENTS

| | | | | | |
|---|---|---|---|---|---|
| 3,875,739 | A | * | 4/1975 | Mougin | 368/38 |
| 3,911,667 | A | * | 10/1975 | Komiyama | 368/38 |
| 4,050,234 | A | * | 9/1977 | Toshio | 368/185 |
| 4,837,755 | A | * | 6/1989 | Besson | 368/38 |
| 5,784,342 | A | * | 7/1998 | Genta | 368/76 |
| 6,305,043 | B1 | * | 10/2001 | Rosnak | 403/111 |
| 2001/0016147 | A1 | * | 8/2001 | Kaneko | 403/374.2 |

FOREIGN PATENT DOCUMENTS

| | | |
|---|---|---|
| CH | 0995174 | 6/1977 |
| JP | 54007811 | 4/1979 |
| JP | 63315979 | 12/1988 |
| JP | 01141487 | 9/1989 |
| JP | 05006584 | 1/1993 |
| JP | 06016334 | 4/1994 |
| JP | 07006791 | 1/1995 |

* cited by examiner

*Primary Examiner*—Jayprakash N. Gandhi
*Assistant Examiner*—Jeanne-Marjuerite Goddwin
(74) *Attorney, Agent, or Firm*—Adams & Wilks

(57) ABSTRACT

An intermittent feed mechanism has a counting wheel and a cam balancer mounted on the counting wheel and having a hole. A feed pawl is mounted on the cam balancer and has a spring portion and a pawl portion. The pawl portion of the feed pawl has a protrusion disposed in the hole of the cam balancer and pressed against an edge portion of the hole by a biasing force of the spring portion.

9 Claims, 9 Drawing Sheets

15/17

INTERMITTENT FEEDING MECHANISM

FIELD OF THE INVENTION

This invention relates to intermittent feed mechanisms and, more particularly, to an intermittent feed mechanism which is to be efficiently assembled with deviation in pawl tip position suppressed.

BACKGROUND OF THE INVENTION

FIG. 9 is a schematic top view showing a conventional intermittent feed mechanism. In this intermittent feed mechanism 500, reference numeral 501 designates a counting wheel. This counting wheel 501 has a counting second hand shaft 511 attached with a minute feed pawl 512 acting parallel to the plane of the counting wheel 501. The minute feed pawl 512 has an elongate spring portion 514 extending from a body portion 513 and a pawl portion 515 formed at a tip of the spring portion.

This pawl portion 515, each time rotating by one turn, engages a gear tooth of the minute counting intermediate wheel 502. In order to properly engage the gear, highly accurate tip position is required for the pawl portion 515. The tip position is adjusted by bending the spring portion 514 during assembling. Meanwhile, a heart cam 516 is mounted on the counting second hand shaft 511. Reference numeral 517 is an eccentric pin that penetrates through the heart cam 516 and counting gear 518. Also, the minute feed pawl 512 is positioned by inserting the eccentric pin 517 in an opening 519 thereof.

Next, the operation of the intermittent feed mechanism 500 will be explained. The rotation of a barrel complete is conveyed to the counting wheel 501 through a counting intermediate train wheel. The counting wheel 501 rotates one turn in 60 seconds. Each time the counting wheel rotates by one turn, the pawl 515 of the minute feed pawl 512 engages the gear of the minute counting intermediate wheel 502. The minute counting intermediate wheel 502 is intermittently moved at one tooth of its gear, pushed by the pawl 515 in rotation. Actually, the rotation of the minute counting intermediate wheel 502 is decelerated and conveyed to the minute counting wheel (not shown).

Meanwhile, the heart cam 516 is rotated by the rotation of the counting wheel 501. Upon zero returning, a hammer at a tip of a hand returning lever is pressed on the heart cam 516 to thereby forcibly rotate the heart cam 516. Although there is a possibility that the pawl portion 515 contacts the gear of the minute counting intermediate wheel 502 due to rotation of the heart cam 516, the counting wheel 501 rotates without causing problem because the elasticity of the spring portion 514 releases the pawl portion 515.

However, in the conventional intermittent feed mechanism 500, the minute feed pawl 512 is fabricated by press-blanking and thereafter subjected to heat treatment. Thus, there has been a problem that the pawl portion 515 deviates from the ideal tip position. The positional deviation in the pawl portion 515 tip possibly causes such trouble as insufficient or excessive force fed to the counting intermediate wheel. For such problems, in conventional devices the spring portion 514 is bent and adjusted during assembling. However, there has been a problem with the time taken for adjustment due to problems such as springback of the spring portion 514, resulting in worsened assembling efficiency. Furthermore, there is another problem that the assembling process steps are increased in number due to fine tip position adjustment of the pawl portion 515 using the eccentric pin 517.

Therefore, this invention has been made in view of the above, and it is an object to provide an intermittent feed mechanism which is to be assembled with efficiency with deviation in pawl tip position suppressed.

SUMMARY OF THE INVENTION

In order to solve the above problem, an intermittent feed mechanism according to the invention has a positioning portion for positioning a feed pawl provided on a counting wheel and provided in part of a structural member of the counting wheel.

If instead of adjustment by bending the spring portion, in this manner a positioning portion for positioning a feed pawl is provided separately, the adjustment by bending or fine adjustment with an eccentric pin is not required. Also, the position deviation of the tip of the feed pawl is reduced.

In another embodiment, an intermittent feed mechanism has a feed pawl having a spring portion provided on a first counting wheel. The feed pawl rotates together with the first counting wheel so that with every turn the feed pawl engages a gear of a second counting wheel or a second counting intermediate wheel, thereby intermittently feeding force to the second counting wheel or the second counting intermediate wheel. A positioning portion is provided in part of the feed pawl, and the feed pawl is positioned by urging the positioning portion on a predetermined portion of the first counting wheel by a spring portion of the feed pawl.

That is, the positioning portion provided on the feed pawl is urged on a predetermined portion of the first counting wheel by the spring portion possessed by the feed pawl. This can generally determine, in the predetermined portion, the tip position of the feed pawl. Accordingly, the feed pawl rarely deviates in its feed pawl tip position. Also, the predetermined portion, if previously machined with accuracy, makes unnecessary any adjustment through bending or the like. Fine adjustment with the eccentric pin is also unnecessary.

In another embodiment, an intermittent feed mechanism has a feed pawl having a spring portion provided on a first counting wheel. The feed pawl rotates together with the first counting wheel so that at every turn the feed pawl engages a gear tooth of a second counting wheel or a second counting intermediate wheel thereby intermittently feeding the second counting wheel or the second counting intermediate wheel. A protrusion is provided on the feed pawl, a positioning hole is provided in a structural member of the first counting wheel, the protrusion being inserted in the positioning hole, and the protrusion being urged in the positioning hole by a spring portion of the feed pawl thereby positioning the feed pawl.

A protrusion is provided on the feed pawl and a positioning hole is provided in the first counting wheel. During assembling the protrusion is inserted in the positioning hole and the protrusion is urged in the positioning hole by the spring portion possessed by the feed pawl. This can generally determine, in the predetermined portion, a tip position of the feed pawl. Accordingly, the feed pawl rarely deviates in feed pawl tip position. Also, the above positioning hole, if previously machined with accuracy, makes unnecessary any adjustment through bending or the like. Furthermore, the eccentric pin can be omitted.

Next, an intermittent feed mechanism according to another embodiment of this invention is characterized in that in the intermittent feed mechanism a protrusion at the tip is made in a hook form.

If in this manner the protrusion is formed in a hook form at the tip, when inserted in the positioning hole the protrusion and the positioning hole hardly disengage only with difficulty.

In another embodiment, an intermittent feed mechanism has a feed pawl having a spring portion provided on a first counting wheel. The feed pawl rotates together with the first counting wheel so that with every turn the feed pawl engages a gear tooth of a second counting wheel or a second counting intermediate wheel, thereby intermittently feeding force to the second counting wheel or the second counting intermediate wheel. A protrusion is provided on a structural member of the first counting wheel, a portion other than the portion to engage the gear of the feed pawl being urged on the protrusion by the spring portion, thereby positioning the feed pawl.

In this case, a protrusion is provided on the side of the counting wheel with the structural member so that the feed pawl is urged on the protrusion. This also can generally determine through the protrusion the feed pawl tip position. Accordingly, the feed pawl hardly deviates in its tip position. Also, adjustment by bending or the like is unnecessary and the eccentric pin can be omitted.

DETAILED DESCRIPTION OF THE PREFERRED EMBODIMENTS

Figure 1:
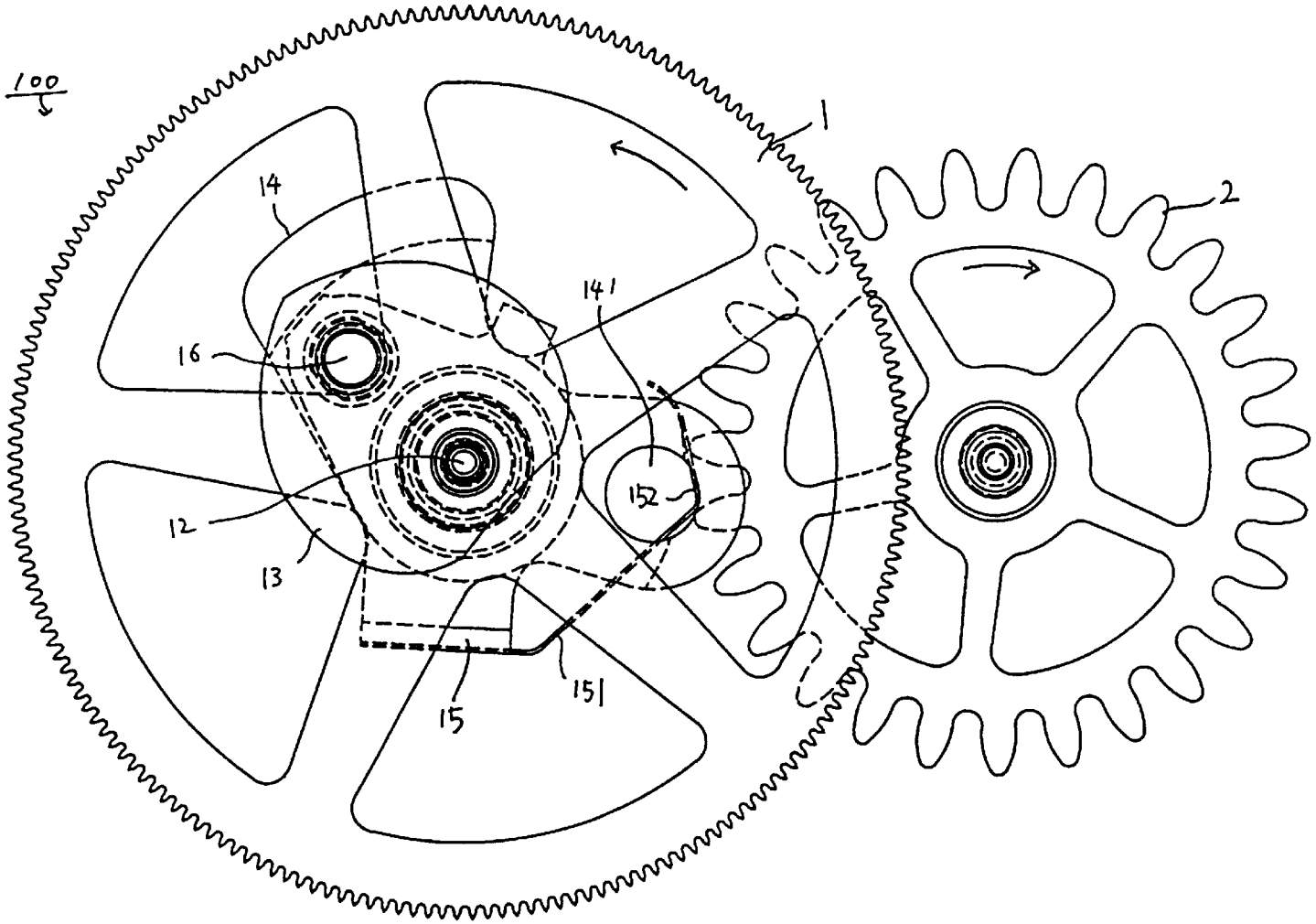
FIG. 1 is a structural view showing an intermittent feed mechanism of this invention.
Figure 2:
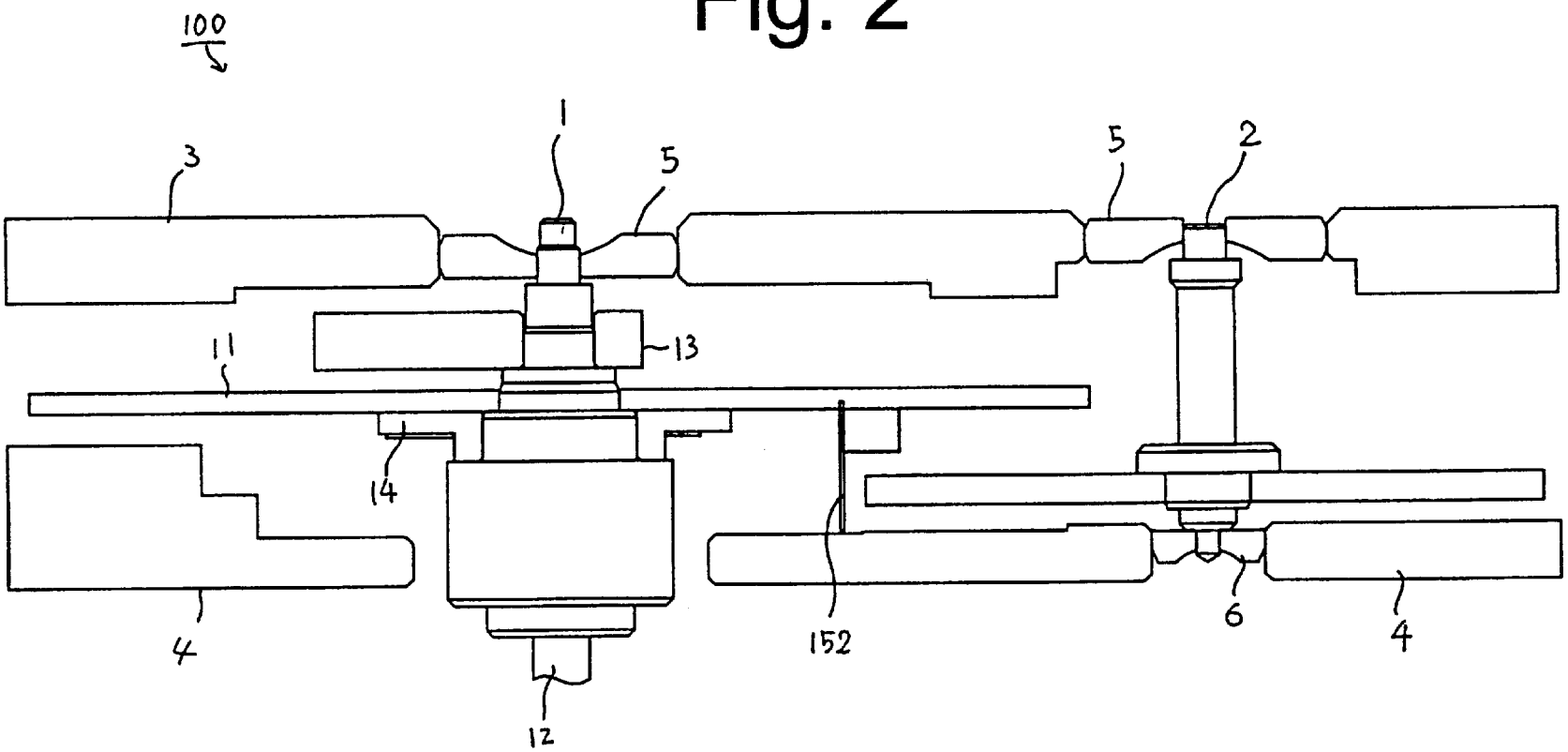
FIG. 2 is a sectional view of the intermittent feed mechanism shown in FIG. 1.

Hereunder, this invention will be explained in detail with reference to the drawings. Note that the invention is not intended to be limited by the described embodiments. FIG. 1 is a structural view showing an intermittent feed mechanism of the invention. FIG. 2 is a sectional view of the intermittent feed mechanism shown in FIG. 1. The intermittent feed mechanism 100 is made up of a counting wheel 1 and a minute counting intermediate wheel 2. The minute counting intermediate wheel 2 is in mesh with a counting intermediate wheel for indicating "minutes" which is herein omitted because it does not aid the explanation. Also, illustration and explanation of a hand returning lever and a counting intermediate train wheel are omitted because they are well known to a person skilled in the art and are not needed for explaining the invention. The counting wheel 1 is rotatably supported at its shaft by a counting bridge 3. The minute counting intermediate wheel 2 is rotatably supported at its shaft by the counting bridge 3 and the third wheel bridge 4. Reference numeral 5 is an upper hole jewel and reference numeral 6 a lower hole jewel.

Figure 3:
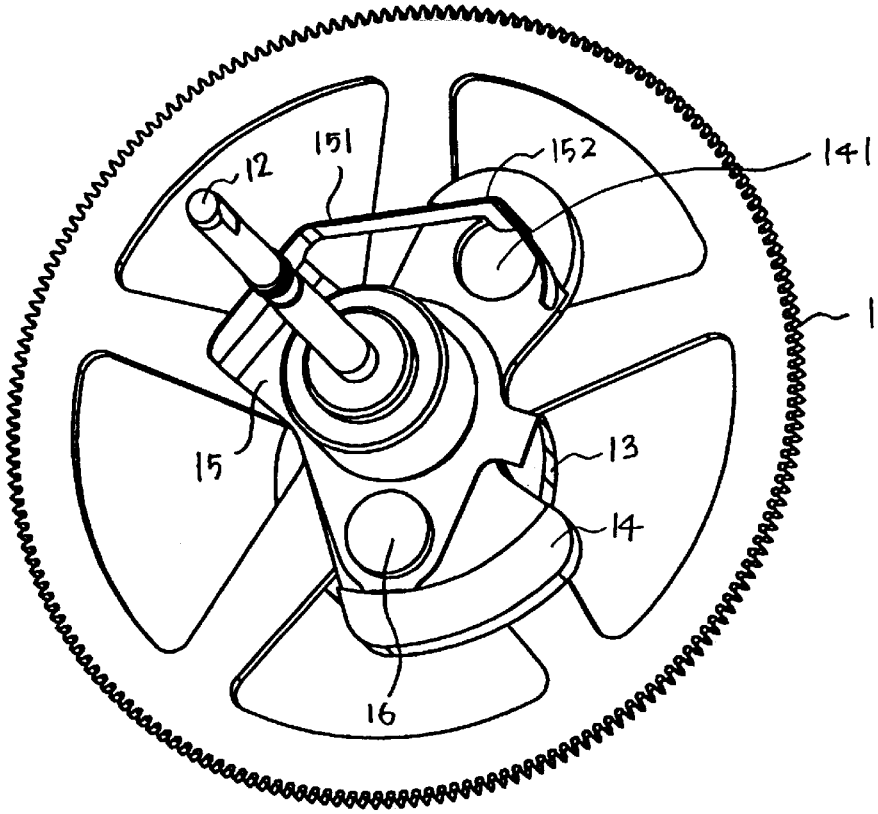
FIG. 3 is a perspective view of a counting wheel shown in FIG. 1 and FIG. 2.
Figure 3:
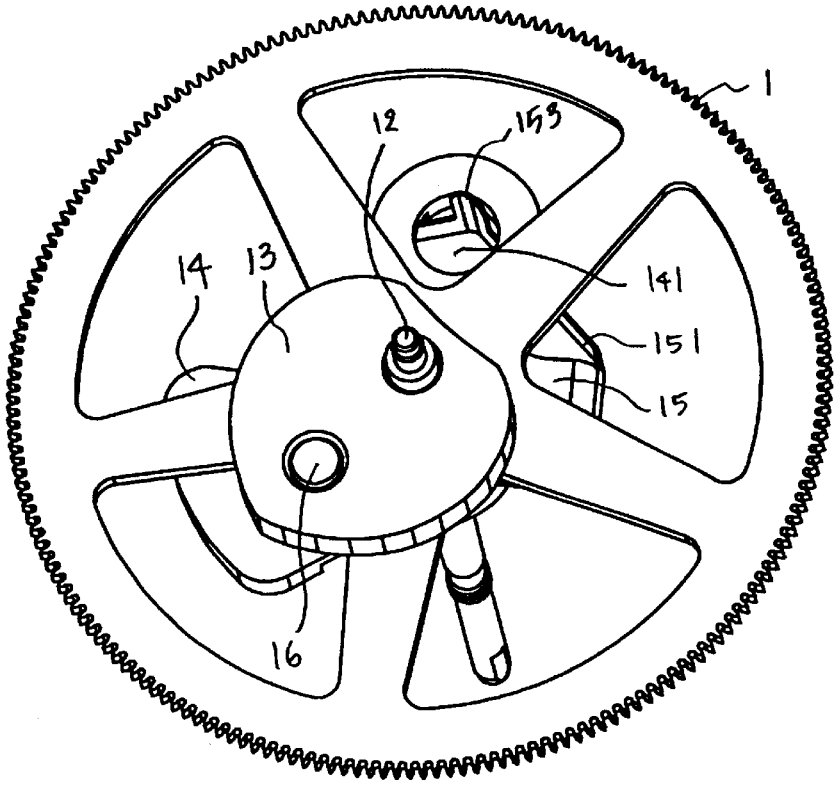
Figure 4:
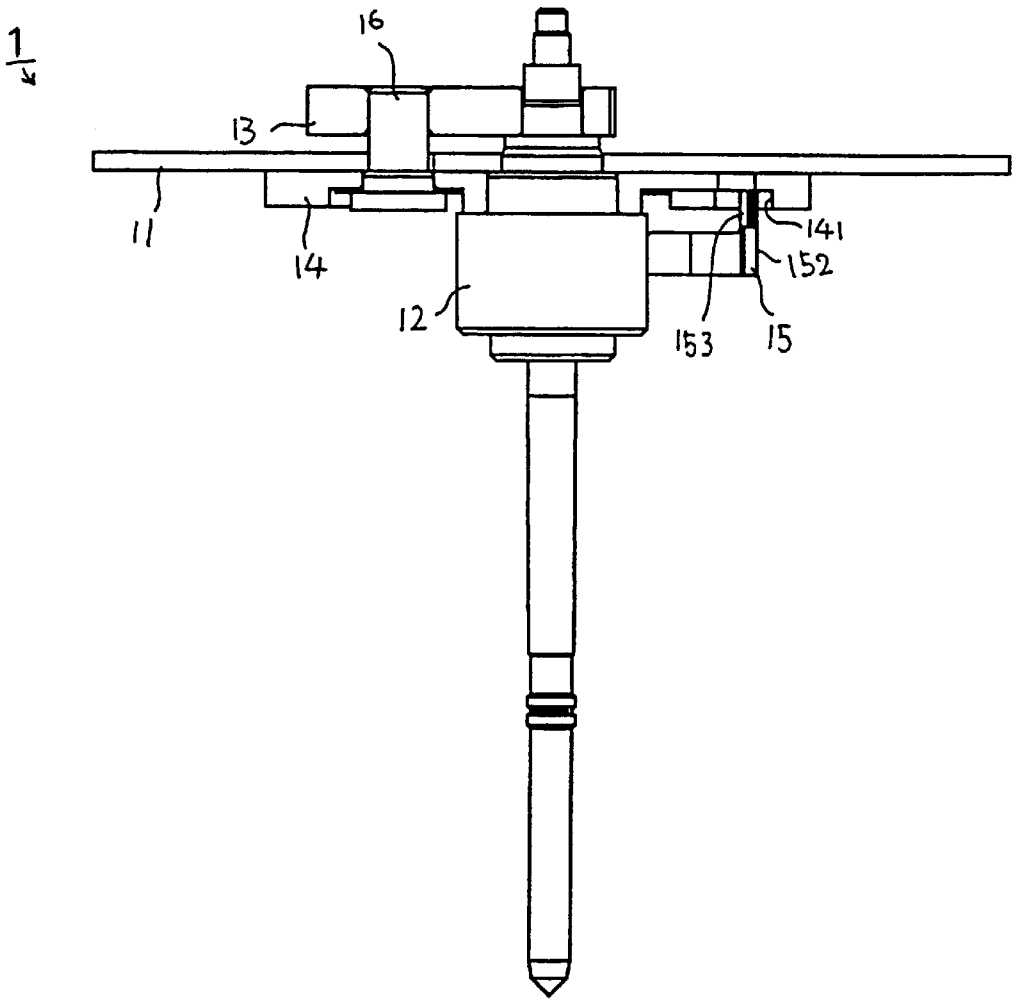
FIG. 4 is a partly broken-away side view of a counting wheel shown in FIG. 1 and FIG. 2.
Figure 5:
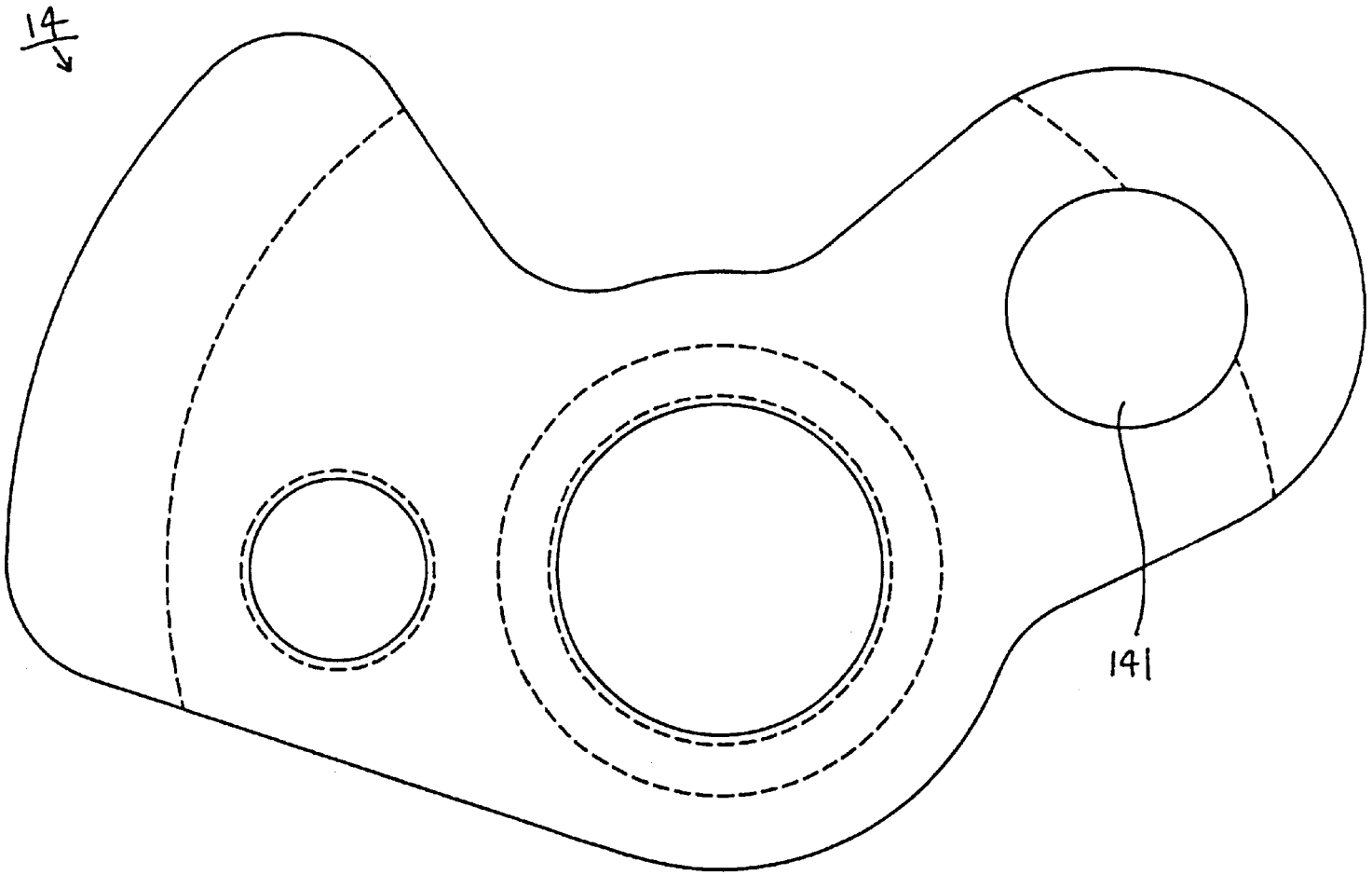
FIG. 5 is a top view showing a heart cam balancer.

FIG. 3 is a perspective view of the counting wheel shown in FIG. 1 and FIG. 2. (a) is a perspective view from below while (b) is a perspective view from above. FIG. 4 is a partly broken-away side view of the counting wheel shown in FIG. 1 and FIG. 2. The counting second hand shaft 12 has a heart cam 13 for zero return mounted on an upper portion thereof with a counting gear 11 taken as a boundary. Meanwhile, the counting second hand shaft 12 has a heart cam balancer 14 shown in FIG. 5.

Figure 6:
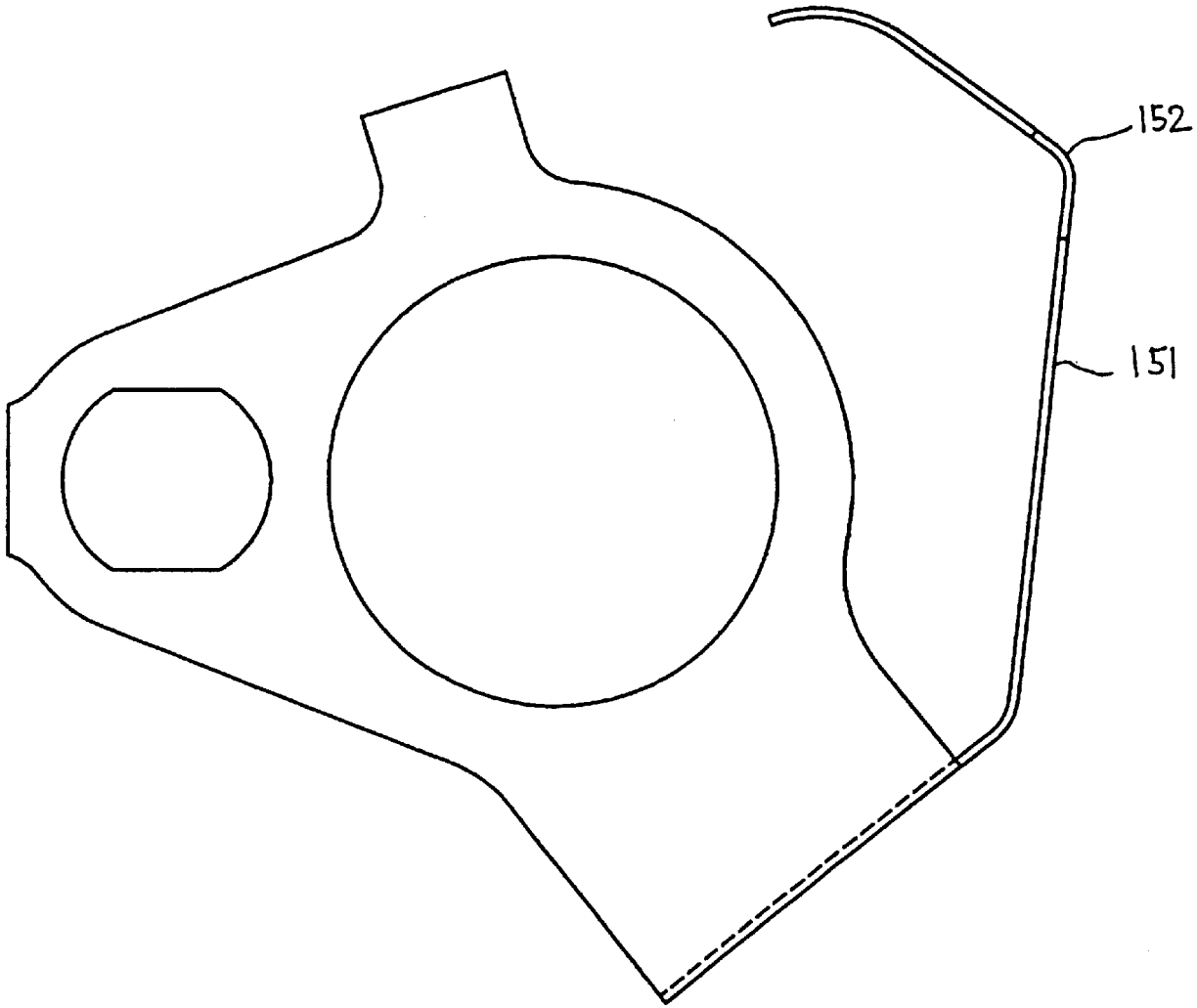
FIG. 6 is a top view showing a minute feed pawl.

The heart cam balancer 14 is attached with a minute feed pawl 15 shown in FIG. 6. The minute feed pawl 15 has a spring portion 151 acting parallel to the plane of the counting wheel 1 and, at its end, a pawl portion 152 to engage a gear tooth of the minute counting intermediate wheel 2. This spring portion 151 and pawl portion 152 are formed by bending. Meanwhile, the pawl portion 152 is positioned precisely at the lower part of the heart cam balancer 14. Furthermore, the pawl portion 152 is provided with a protrusion 153 for use in positioning. On the other hand, the heart cam balancer 14 is opened with a hole 141 for use in positioning. A pin 16 penetrates through the heart cam balancer 14, the minute feed pawl 15, the counting gear 11 and the heart cam 13 thereby fixing them in position.

Figure 9:
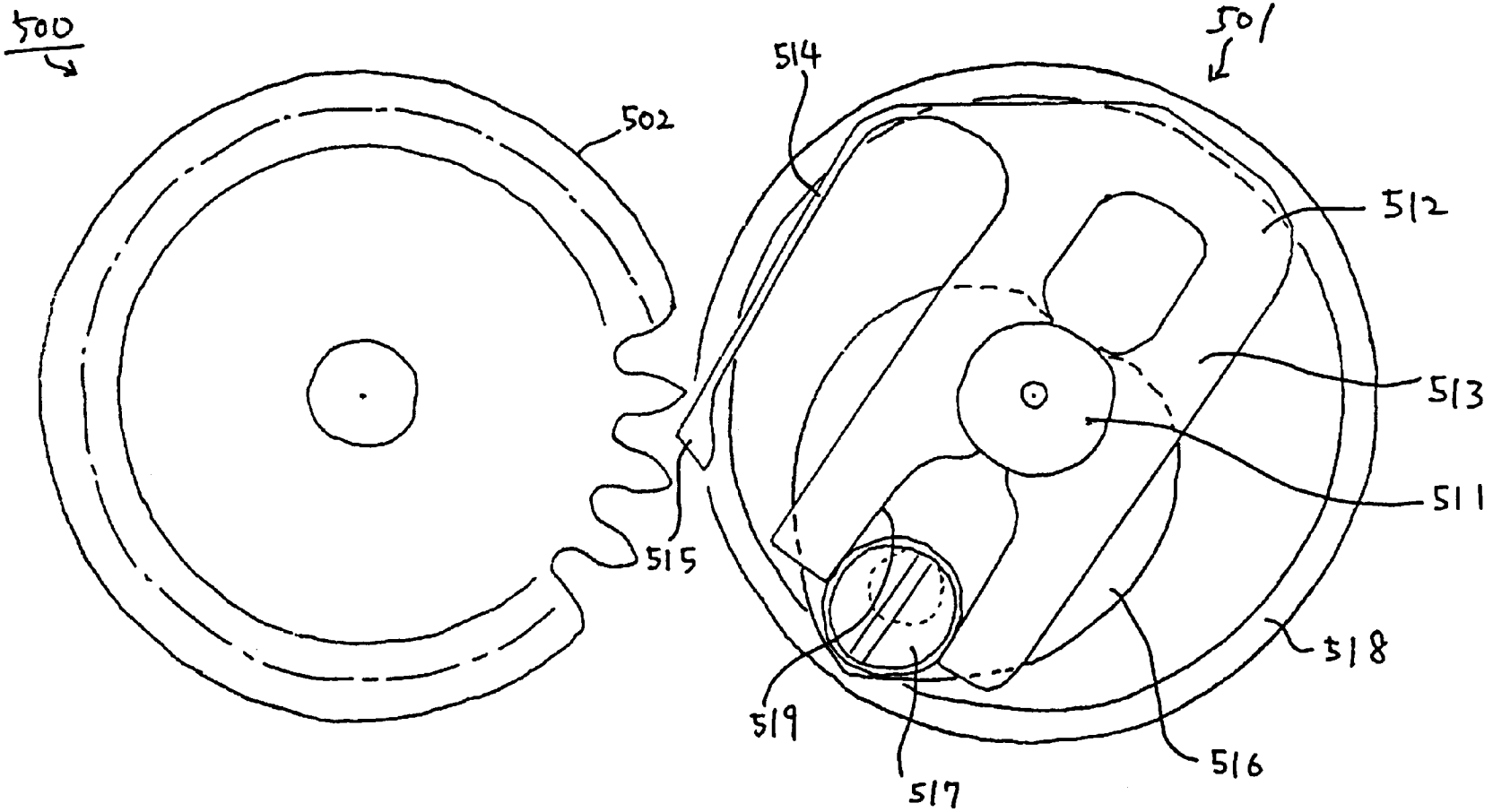
PRIOR ART Fig. 9
FIG. 9 is s schematic top view showing a conventional intermittent feed mechanism.

When assembling a counting wheel 1, the protrusion 153 provided on the pawl portion 152 is inserted in the hole 141 provided in the heart cam balancer 14. Then, the protrusion 153 is urged on an edge of the hole 141 through a force of the spring portion 151 (see (b) of FIG. 1). By doing so, the pawl portion 153 has its tip positional accuracy rendered dependent upon the positional accuracy of the hole 141. The hole 141 can effectively suppress deviation in pawl tip position because it is accurately formed by pressing. Also, because merely the protrusion 153 is inserted in the hole 141, there is no need of adjustment due to bending in the spring portion (see FIG. 9) as is conventionally required, which correspondingly enhances assembling efficiency.

Next, the operation of the intermittent feed mechanism 100 will be explained. The rotation of a barrel complete is transmitted to the counting wheel 1 through the counting intermediate train wheel. The counting wheel rotates once per 60 seconds. Each time the counting wheel 1 rotates once, the pawl portion 152 of the minute feed pawl 15 engages the gear teeth of the minute counting intermediate wheel 2. The minute counting intermediate wheel 2 intermittently has force imparted to one tooth of its gear by pushing of the rotating pawl portion 152. In reality, the rotation of the minute counting intermediate wheel 2 is decelerated, and this is transmitted to the minute counting wheel (not shown).

In zero return, a hammer at the tip of the hand returning lever is pressed against the heart cam 13 to forcibly rotate the heart cam 13. There is a possibility that the minute pawl 15 be contacted with the gear of the minute counting intermediate wheel 2 due to rotation of the heart cam 13. The counting wheel 1 however rotates without problem because the pawl portion 152 is released by an elastic force of the spring portion 151. Incidentally, although the above was explained using the example of the counting wheel 1 for indicating "second", the counting wheel for indicating "minute" may be explained in the same way as the "second"-indicating counting wheel. Meanwhile, the invention of this intermittent feed mechanism is applicable directly or through modification to a part requiring intermittent feed.

Figure 7:
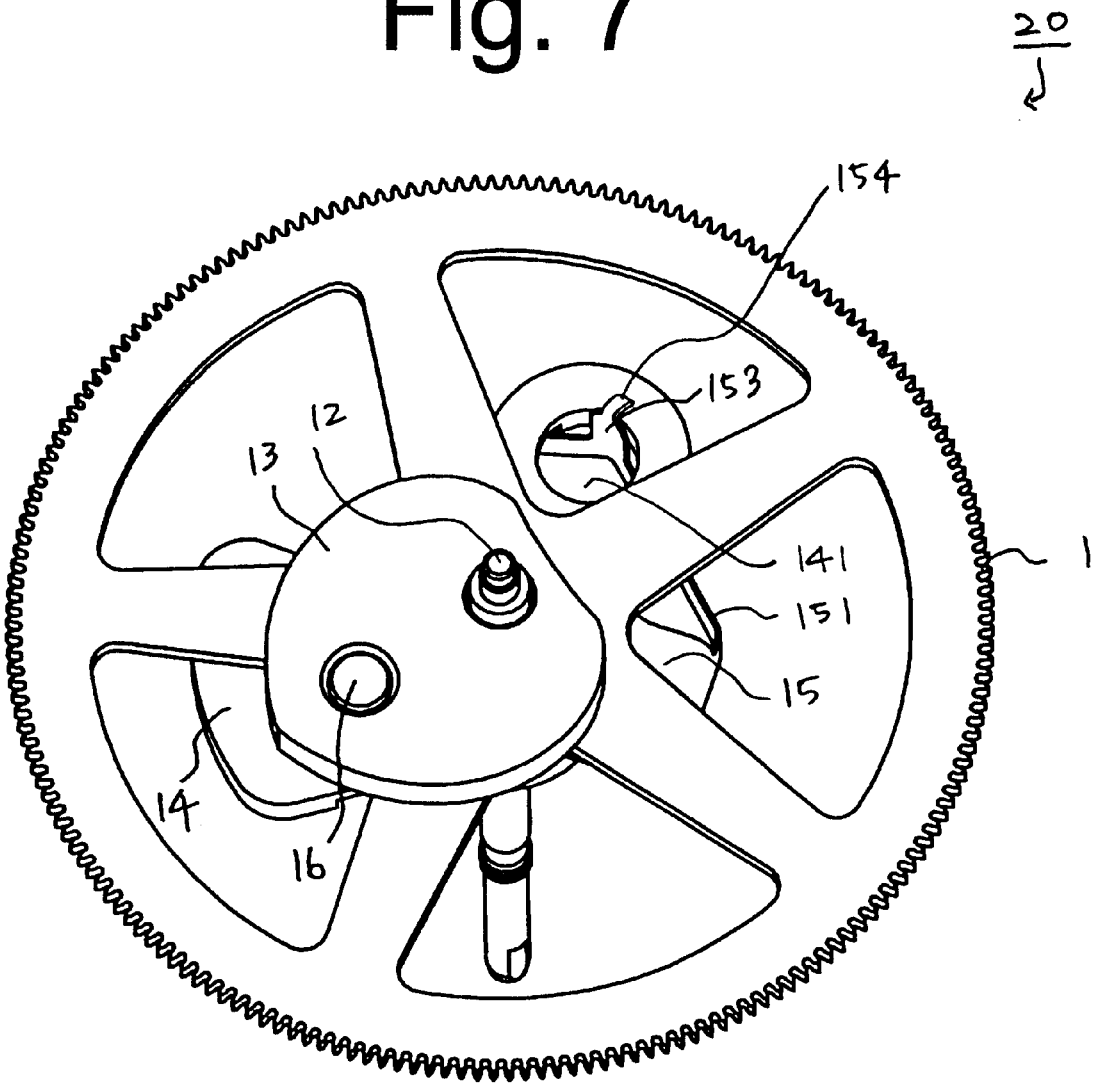
FIG. 7 is a perspective view showing a modification of the counting wheel.
Figure 8:
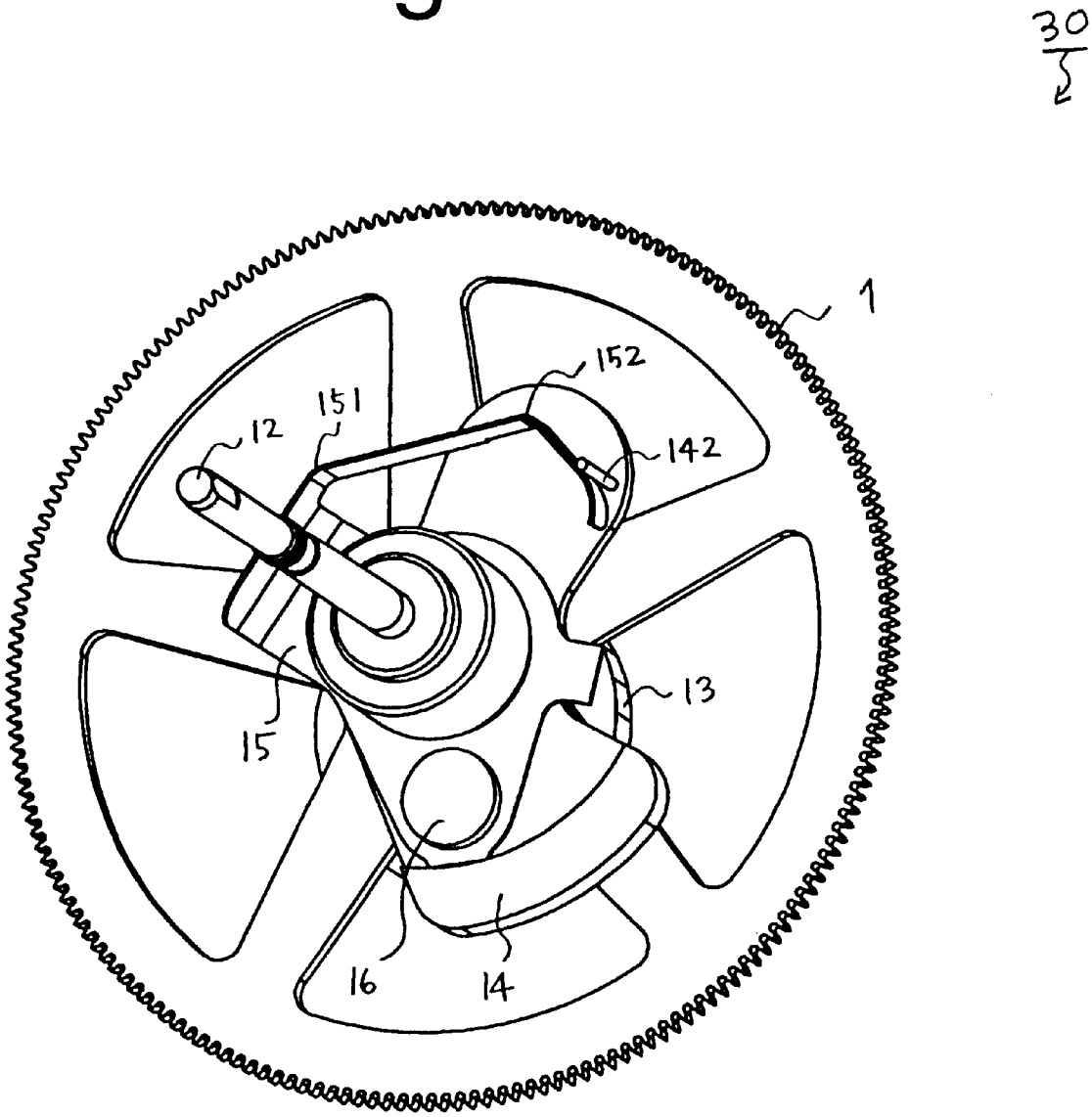
FIG. 8 is a perspective view showing a modification of the counting wheel.

FIG. 7 is a perspective view showing a modification to the counting wheel 1. As shown in the figure, the tip shape of the protrusion 153 may be in a hook form. When assembling a counting wheel 20, the protrusion 153 is in a state inserted in the hole 141 and the hook 154 is opposed to a peripheral edge of the hole 141 through a slight gap. Consequently, even if the protrusion 153 moves vertically, the hook 154 engages the peripheral edge of the hole 141 and accordingly the protrusion 153 will not disengage from the hole 141. This improves reliability of the counting wheel 1. Meanwhile, FIG. 8 is a perspective view showing another modification to the counting wheel 1.

In this counting wheel 30, in place of providing a protrusion 153 on a side of the minute feed pawl 15 a protrusion 142 is provided on a side of the heart cam balancer 14 as shown in the same figure. In this counting wheel 30, the minute feed pawl 15 is urged on the protrusion 142 to position the minute feed pawl 15. In this case, because there is no necessity to provide a hole (at reference numeral 141 in FIG. 3) in the heart cam balancer 14, the counting wheel 30 is simplified in structure.

INDUSTRIAL APPLICABILITY

As explained above, in an intermittent feed mechanism according to an embodiment of the present invention, the positioning portion for positioning a feed pawl provided on the counting wheel is provided in part of the structural member of the counting wheel. Accordingly, there is no necessity of adjusting by bending a spring portion, thereby making assembling easy. Also, because the feed pawl is positioned by the positioning portion, the feed pawl is reduced in tip position deviation. Furthermore, because fine adjustment due to an eccentric pin is unnecessary, it is possible to reduce the number of assembling processes and the number of parts.

According to an intermittent feed mechanism in another embodiment of the present invention, because the positioning portion provided on the feed pawl is urged on a predetermined portion of a first counting wheel by the spring portion provided on the feed pawl, the feed pawl can be generally determined in tip position by the predetermined portion. Accordingly, the feed pawl is less liable to deviate in tip position. Also, because positioning is dine by the predetermined portion, there is no necessity of adjustment by bending or the like, improving assembling efficiency. furthermore, because the fine adjustment by an eccentric pin is unnecessary, it is possible to reduce the number of assembling processes and the number of parts.

In an intermittent feed mechanism according to another embodiment of the present invention, a protrusion is provided and a positioning hole in a structural member for the first counting wheel. Then, the protrusion is inserted in the positioning hole and the protrusion is urged in the positioning hole by the spring portion possessed by the feed pawl. This can generally determined a feed pawl tip position by the positioning hole hence reducing deviation in feed pawl tip position. Also, the adjustment by bending is unnecessary improves assembling efficiency.

Furthermore, because the fine adjustment by an eccentric pin becomes unnecessary, it is possible to reduce the number of assembling processes and the number of parts.

According to an intermittent feed mechanism in another embodiment of the present invention, because the protrusion at a tip is made in a hook form, when inserted in the positioning hole, the protrusion and the positioning hole are less liable to disengage. This increases reliability of the counting wheel.

According to an intermittent feed mechanism in another embodiment of the present invention, a protrusion is provided on the structural member side of the counting wheel, urging the feed pawl on this protrusion. Accordingly, the feed pawl can be generally determined in tip position, thereby reducing deviation in the feed pawl tip position. Also, the adjustment by bending is unnecessary, improving assembling efficiency. Furthermore, because the fine adjustment by an eccentric pin is unnecessary, it is possible to reduce the number of assembling processes and the number of parts.

What is claimed is:

1. An intermittent feed mechanism comprising: a first counting wheel for undergoing rotation; a cam balancer mounted on the first counting wheel and having a hole; a second counting wheel having a gear; and a feed pawl mounted on the first counting wheel for rotation therewith to engage the gear of the second counting wheel upon each preselected rotation amount of the feed pawl to thereby intermittently feed a rotational driving force to the second counting wheel, the feed pawl having a spring portion and a pawl portion, the pawl portion having a protrusion disposed in the hole of the cam balancer and pressed against an edge portion of the hole by a biasing force of the spring portion.

2. An intermittent feed mechanism as claimed in claim 1; wherein the protrusion of the pawl portion has a generally hooked-shaped tip.

3. An intermittent feed mechanism comprising: a counting wheel; a cam balancer mounted on the counting wheel and having a hole; and a feed pawl mounted on the cam balancer and having a spring portion and a pawl portion, the pawl portion having a protrusion disposed in the hole of the cam balancer and pressed against an edge portion of the hole by a biasing force of the spring portion.

4. An intermittent feed mechanism according to claim 3; wherein the protrusion of the pawl portion has a generally hook-shaped tip.

5. An intermittent feed mechanism comprising: a counting wheel having a first side, a second side opposite the first side, and a shaft extending from the first side to the second side; a generally heart-shaped cam mounted on the shaft of the counting wheel at the first side thereof; a generally heart-shaped cam balancer mounted on the shaft of the counting wheel at the second side thereof and having a hole; and a feed pawl mounted on the cam balancer and having a spring portion and a pawl portion, the pawl portion having a protrusion disposed in the hole of the cam balancer and pressed against an edge portion of the hole by a biasing force of the spring portion to thereby position the feed pawl relative to the cam balancer and suppress a variation in position thereof.

6. An intermittent feed mechanism according to claim 5; wherein the protrusion of the pawl portion has a generally hook-shaped tip.

7. An intermittent feed mechanism according to claim 6; wherein the hook-shaped tip engages a peripheral edge of the hole of the cam balancer.

8. An intermittent feed mechanism according to claim 5; further comprising a pin extending through the cam balancer, the feed pawl and the cam for positioning the cam balancer, the feed pawl and the cam relative to one another.

9. An intermittent feed mechanism comprising: a counting wheel; a cam balancer mounted on the counting wheel and having a protrusion extending therefrom; and a feed pawl mounted on the cam balancer and having a pawl portion and a spring portion for biasing the pawl portion into contact with the protrusion of the cam balancer to thereby position the feed pawl relative to the cam balancer and suppress a variation in position thereof.

* * * * *